United States Patent [19]

Okui et al.

[11] Patent Number: 4,568,416

[45] Date of Patent: Feb. 4, 1986

[54] TAPING PACKAGE METHOD FOR SMALL-SIZE ELECTRONIC PARTS

[75] Inventors: Tokujiro Okui, Toyonaka; Takahachiro Taira, Ibaragi, both of Japan

[73] Assignee: Tokujiro Okui, Japan

[21] Appl. No.: 652,971

[22] Filed: Sep. 21, 1984

[30] Foreign Application Priority Data

Jun. 6, 1984 [JP] Japan ..... 59-117143
Jun. 6, 1984 [JP] Japan ..... 59-117144

[51] Int. Cl.[4] ..... B32B 31/16; B65D 73/02; B65D 85/42

[52] U.S. Cl. ..... 156/252; 156/253; 206/329; 206/330; 206/331

[58] Field of Search ..... 156/252, 253; 29/576 S; 206/328, 329, 330, 331; 53/235, 244, 255, 443, 448, 450, 542, 543

[56] References Cited

U.S. PATENT DOCUMENTS

| | | | |
|---|---|---|---|
| 2,518,450 | 8/1950 | Cowen et al. | 206/331 |
| 3,069,751 | 12/1962 | Deakin | 206/330 |
| 3,245,193 | 4/1966 | Schmidt | 53/448 |
| 4,049,118 | 9/1977 | Honda et al. | 206/330 |
| 4,231,901 | 11/1980 | Berbeco | 206/331 |

*Primary Examiner*—Caleb Weston
*Attorney, Agent, or Firm*—Sidney W. Millard

[57] ABSTRACT

Small-size electronic parts having leads are packaged with a carrier tape composed of a tape base having tape feed holes and a tape body of electrically conductive or nonconductive formed plastic attached to one side of the tape base. The carrier tape is unreeled from a supply reel, and the leads of the electronic parts are caused to pierce an upper surface and one side or both sides of the tape body. The carrier tape with the electronic parts retained on the tape body is wound around a takeup reel. With the method of the invention, small-side electronic parts with long leads can easily be packaged with a tape, the packaged electronic parts can easily be shipped and stored, and the electronic parts can easily be detached form the carrier tape.

8 Claims, 10 Drawing Figures

TAPING PACKAGE METHOD FOR SMALL-SIZE ELECTRONIC PARTS

BACKGROUND OF THE INVENTION

1. Field of the Invention

The present invention relates to a method for packaging, with a tape, various on-chip electronic parts having leads such as switches, semifixed rheostats, diodes, transistors and the like for use in electronic devices.

2. Description of the Prior Art

As electronic devices have become smaller in size and higher in performance in recent years, more and more electronic parts are fabricated on chips. There are growing demands for packaging such on-chip electronic parts on a mass-production basis with an automatic inserting machine.

There are several known methods for packaging, with a tape, on-chip electronic parts such as resistors, capacitors, coils, semiconductors, and the like. Such packaging methods, use a paper tape with punched rectangular holes and circular feed holes or a plastic tape molded with rectangular recesses and circular feed holes. FIG. 8 of the accompanying drawings illustrates a taping method employing a paper tape with punched rectangular holes and circular feed holes. This prior art is disclosed in commonly owned, copending, U.S. patent application Ser. No. 518,544 filed on July 29, 1983. According to the disclosed method, a composite tape (generally called a "carrier tape") 1 is composed of a tape base 1-2 having parts-housing rectangular holes 1-3 and circular feed holes 1-4, both punched therein, and a cover tape 1-5 attached to one side of the tape base 1-2. In operation, the carrier tape 1 is unreeled from a taping reel 2-1, on-chip parts are inserted into the rectangular holes 1-3, respectively, a cover tape 1-6 is attached to the tape 1 in covering relation to the parts, and the resultant tape is wound around a taping reel 2-2. Where the plastic tape with rectangular recesses and circular feed holes is used, on-chip parts are inserted in the rectangular recesses and a cover tape is applied over the inserted parts, followed by winding up the resulting tape.

The known packaging methods are however limited to only on-chip electronic parts such as resistors, capacitors, coils, semiconductors, and the like, particularly those having short leads, but are not effective in packaging electronic parts having long leads, such as diodes, transistors and the like. The electronic parts with long leads could be packaged with tapes by increasing the width and thickness of the tape and enlarging parts-housing holes, or using carrier tapes designed for exclusive use with respective types of electronic parts. Such methods however would be costly. Since the current trend in the electronic industry is toward the use of more and more electronic parts with long leads, there has been a strong demand in the industry for a method capable of economically packaging such electronic parts with a tape.

SUMMARY OF THE INVENTION

With the above demand in view, it is an object of the present invention to provide a packaging method capable of efficiently and economically packaging, with a tape, small-size electronic parts having long leads.

According to the present invention, a tape body of electrically conductive or nonconductive foamed plastic is attached to one surface of a tape base having circular tape feed holes. Small-size electronic parts are successively placed on one side or both sides of the tape body with their leads piercing the tape body, and the resultant tape-packaged parts are wound on a takeup reel.

The tape body of the invention is therefore devoid of any parts-insertion holes. The electronic parts are retained on the tape body simply by having their leads pierce the tape body. With the method of the invention, it is not necessary to punch parts housing holes in the tape body, and those electronic parts having long leads can all be mounted securely on the tape body irrespectively of the sizes of the parts.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

Figure 1:
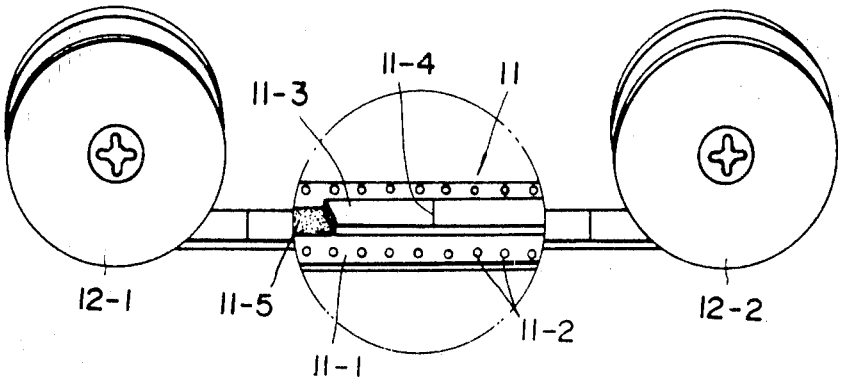
FIG. 1 is a perspective view, partly at an enlarged scale, showing a carrier tape used in a taping package method for packaging small electronic parts according to the present invention.

As shown in FIG. 1, a carrier tape 11 used in a taping package method of the invention is composed of a tape base 11-1 having circular tape feed holes 11-2 punched in rows along opposite longitudinal edges and an elongate continuous tape body 11-3 of foamed plastic attached to one side of the tape base 11-1 for supporting electronic parts thereon. The tape body 11-3 has a width W and a thickness t which are selected to meet the size of electronic parts 13 to be mounted and the length of lead wires 13-1 of the electronic parts 13 so that the electronic partsd will not cover the feed holes 11-2 or will not extend beyond the tape width.

The tape body 11-3 of foamed plastic should preferably be electrically conductive since some electronic parts to be packaged are susceptible to damage due to an electrostatic charge. The tape body 11-3 may be rendered electrically conductive by mixing carbon, for example, into the foamed plastic.

The tape base 11-1 may of any desired material. However, since the tape base 11-1 should not elongate or contract under various environmental conditions such as temperature or tension to ensure accurate positions for mounting and picking up electronic parts, the tape base should preferably be of paper which is made nonstretchable and noncontractable by being coated with silicone.

Figure 2A:
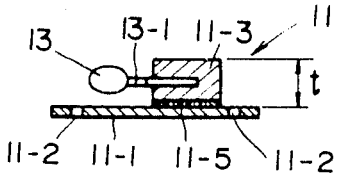
FIG. 2A is a transverse cross-sectional view showing the manner in which an electronic part is packaged with a tape according to the method of the present invention.
Figure 2B:
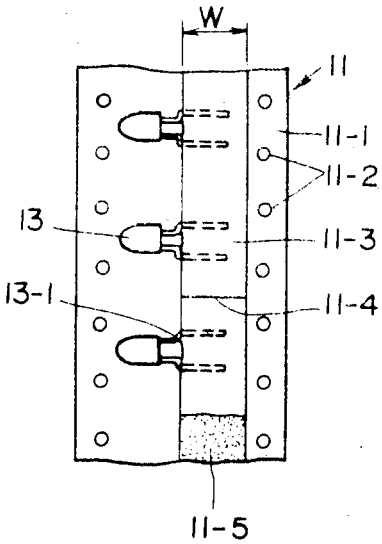
FIG. 2B is a fragmentary plan view illustrating the manner in which electronic parts are packaged with a tape according to the method of the present invention.

Packaging small-size electronic parts having long leads with the above carrier tape 11 will now be described. The carrier tape 11 wound around a taping reel 12-1 is continuously unreeled by a suitable mechanical device (not shown) as shown in FIG. 1. Leads 13-1 of small-size electronic parts 13 such as diodes are held in confronting relation to one side of the tape body 11-3 by a mounting device (not shown) having a presser mechanism, and then are pushed against the surface of the tape body 11-3 so that the side of the tape body 11-3 is pierced successively with the leads 13-1 at certain intervals (FIGS. 2A and 2B). The carrier tape 11 with the small-size electronic parts 13 retained thereon is then wound on another taping reel 12-2. To allow the carrier tape 11 to be wound easily, it should preferably be provided with slits 11-4 at suitable longitudinal intervals.

Figure 3:
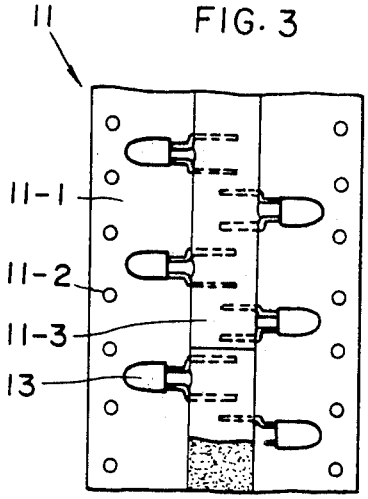
FIGS. 3 and 4 are fragmentary plan views showing taping package methods according to other embodiments of the present invention.
Figure 4:
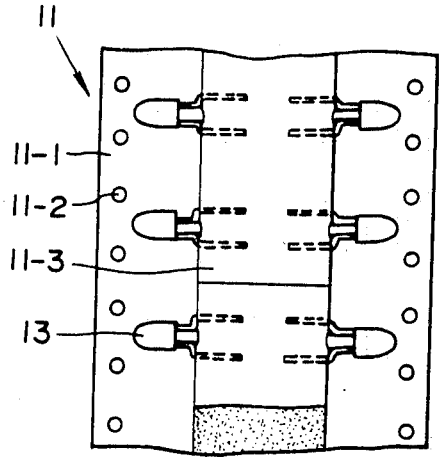
Figure 5A:
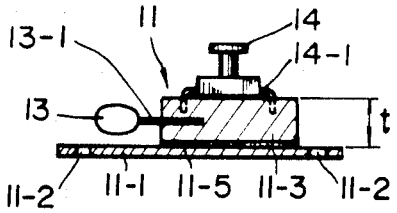
FIG. 5A is a transverse cross-sectional view showing the manner in which an electronic part is packaged with a tape according to a taping package method according to still another embodiment of the present invention.
Figure 5B:
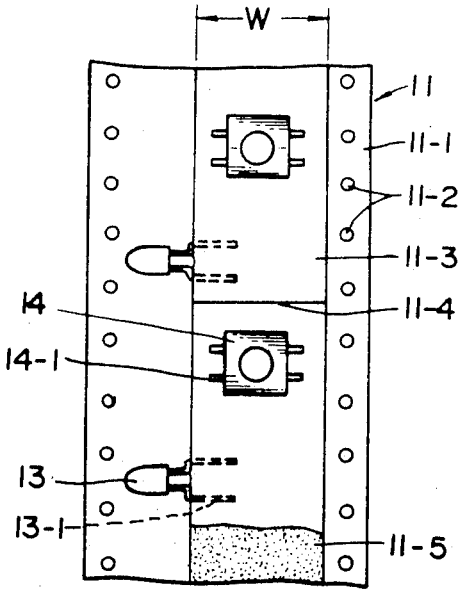
FIG. 5B is a fragmentary plan view illustrating the manner in which electronic parts are packaged with a tape according to the method shown in FIG. 5A.
Figure 6:
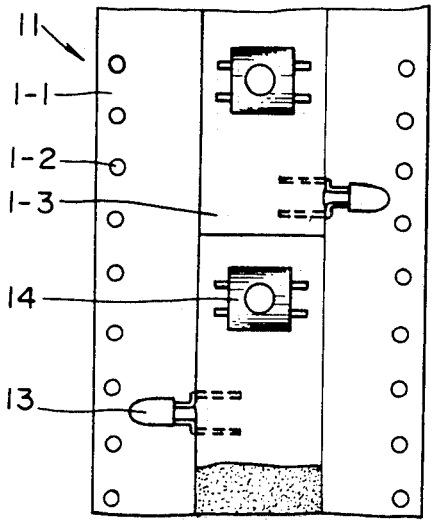
FIGS. 6 and 7 are fragmentary plan views showing taping package methods according to still further embodiments of the present invention.
Figure 7:
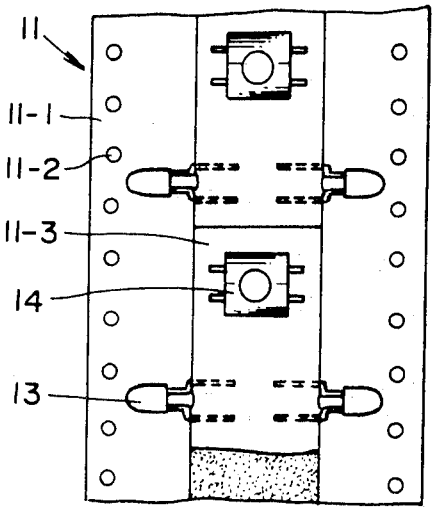
Figure 8:
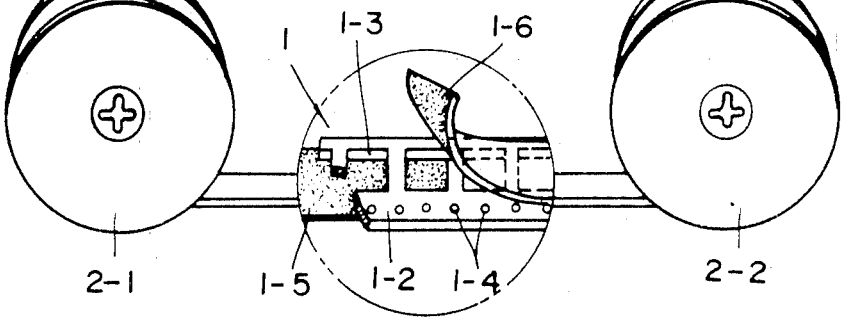
FIG. 8 is a perspective view showing a conventional taping package method for small-size electronic part.

With the above taping package method, the tape body 11-3 of foamed plastic is applied to the tape base 11-1 near one longitudinal edge thereof, and the small-size electronic parts 13 are successively mounted with their leads piercing one side of the tape body at certain intervals as shown in FIGS. 2A and 2B. FIG. 3 shows another taping package method of the present invention, in which a tape base 11-1 has an increased width, and a tape body 11-3 of foamed plastic having the same width w and thickness t as described above is applied centrally to the tape base 11-1. Small-size electronic parts 13 are mounted with their leads piercing both sides of the tape body at given intervals in a staggered pattern. FIG. 4 illustrates still another taping package method of the present invention, in which a tape base 11-1 has an increased width, and a tape body 11-3 of foamed plastic having the same thickness t as described above and a width which is twice the width w is applied centrally to the tape base 11-1. Small-size electronic parts 13 are mounted with their leads piercing both sides of the tape body at given intervals in confronting relation. Furthermore, as shown in FIGS. 5A and 5B, the leads 14-1 of small-size electronic parts 14 such as switches may also pierce an upper surface of a tape body 11-3 of foamed plastic. FIG. 6 illustrates a still further taping package method of the present invention, in which a tape base 11-1 has an increased width, and a tape body 11-3 of foamed plastic having the same width w and thickness t as described above is applied centrally to the tape base 11-1. Small-size electronic parts 13, 14 are mounted with their leads piercing both sides and an upper surface of the tape body at given intervals in confronting relation. FIG. 7 shows an additional taping package method in which small-size electronic parts 13, 14 may be mounted with their leads alternately piercing an upper surface and both sides of a tape body 11-3.

When removing the small-size electronic parts 13, 14 from the carrier tape 11 wound on the taping reel 12-2, the carrier tape 11 is unreeled from the reel 12-2 by a mechanical device (not shown), and the electronic parts 13, 14 are lifted off the tape body 11-3 by a suitable means such as an air suction device.

With the method of the invention, the small-size electronic parts are retained in place on the carrier tape with their leads piercing the tape body, and will not be dislodged from the wounded carrier tape even under vibrations or impacts applied. Since the tape body of foamed plastic is resilient, and is deposited on the tape base, the carrier tape can dampen applied vibrations and shocks so that the packaged electronic parts can be protected against undesirable vibrations and shocks during shipment. The tape body in the form of an elongate web can be pierced by short and long leads of electronic parts regardless of the size of the electronic parts. Accordingly, it is not necessary to provide as many different carrier tapes as there are different types of electronic parts to be packaged.

Although certain preferred embodiments have been shown and described, it should be understood that many changes and modifications may be made therein without departing from the scope of the appended claims.

What is claimed is:

1. A method for packaging small-size electronic parts having leads with a carrier tape composed of a tape base having tape feed holes and a tape body of foamed plastic attached to one side of the tape base, comprising the steps of:

(a) causing the leads of the electronic parts to pierce at least one side of the tape body; and (b) winding the carrier tape with the electronic parts retained on the tape body around a reel.

2. A method according to claim 1, wherein an upper surface of the tape body is also pierced with the leads of the electronic parts.

3. A method according to claim 1, wherein said tape body is electrically conductive.

4. A method according to claim 3, wherein said tape body contains carbon mixed therein.

5. A method according to claim 1, wherein said tape base is rendered nonstretchable and noncontractable by being coated with silicone.

6. A method according to claim 1, wherein said tape body has slits at longitudinal intervals.

7. A method according to claim 1, wherein the leads of the electronic parts pierce both sides of said tape body at intervals in a staggered pattern.

8. A method according to claim 1, wherein said tape body has a width which is at least twice the length of the leads of the electronic parts, the leads of the electronic parts piercing both sides of said tape body at intervals in confronting relation.

* * * * *